US010927607B2

(12) United States Patent
Liao et al.

(10) Patent No.: US 10,927,607 B2
(45) Date of Patent: Feb. 23, 2021

(54) DRILLING SPEED INCREASING DEVICE DRIVEN BY DOWNHOLE MOTOR FOR GENERATING SHOCK VIBRATION

(71) Applicant: CHINA UNIVERSITY OF PETROLEUM (EAST CHINA), Shandong (CN)

(72) Inventors: Hualin Liao, Shandong (CN); Can Yi, Shandong (CN); Jilei Niu, Shandong (CN); Zhichuan Guan, Shandong (CN); Zhonghai Zhou, Shandong (CN); Yucai Shi, Shandong (CN); Yongwang Liu, Shandong (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 0 days.

(21) Appl. No.: 16/804,779

(22) Filed: Feb. 28, 2020

(65) Prior Publication Data

US 2020/0199959 A1 Jun. 25, 2020

Related U.S. Application Data

(63) Continuation of application No. PCT/CN2018/102274, filed on Aug. 24, 2018.

(30) Foreign Application Priority Data

Jan. 17, 2018 (CN) ..... 2018 1 0042523

(51) Int. Cl.

| | |
|---|---|
| ***E21B 7/24*** | (2006.01) |
| *E21B 31/00* | (2006.01) |
| *E21B 4/00* | (2006.01) |

(52) U.S. Cl.

CPC ..... *E21B 7/24* (2013.01); *E21B 4/00* (2013.01); *E21B 31/005* (2013.01)

(58) Field of Classification Search

CPC ..... E21B 7/24; E21B 4/00; E21B 31/005

See application file for complete search history.

(56) References Cited

U.S. PATENT DOCUMENTS 3,807,512 A * 4/1974 Pogonowski ..... E21B 6/00 175/106
6,279,670 B1 * 8/2001 Eddison ..... E21B 4/02 175/107

(Continued)

FOREIGN PATENT DOCUMENTS

CN 103375132 A 10/2013
CN 103375133 A 10/2013

*Primary Examiner* — Christopher J Sebesta

(74) *Attorney, Agent, or Firm* — Prakash Nama; Global IP Services, PLLC

(57) ABSTRACT

The present invention discloses a drilling speed increasing device driven by a downhole motor for generating shock vibration. The device uses the rotational energy of a screw motor as power to drive a lower vibration starter to rotate. Vibration starting steel balls have the function of reducing friction in the interior. During axial reciprocating motion of the upper vibration starter, a spring matched with the upper vibration starter is periodically compressed to generate spring energy. The spring energy reacts on the lower vibration starter and a main shaft connected with a drill bit, so as to periodically provide drilling pressure for the drill bit. Periodic motion of the upper vibration starter and the spring produces periodic axial vibration on the tool.

1 Claim, 5 Drawing Sheets

(56) References Cited

U.S. PATENT DOCUMENTS

2014/0246234 A1* 9/2014 Gillis ..... E21B 10/083
175/24
2019/0024459 A1* 1/2019 Sicilian ..... E21B 28/00

* cited by examiner

DRILLING SPEED INCREASING DEVICE DRIVEN BY DOWNHOLE MOTOR FOR GENERATING SHOCK VIBRATION

CROSS-REFERENCE TO RELATED APPLICATIONS

This application is a continuation of International Patent Application No. PCT/CN2018/102274, filed on Aug. 24, 2018, which claims the benefit of priority from Chinese Patent Application No. 201810042523.0, filed on Jan. 17, 2018. The contents of the aforementioned application, including any intervening amendments thereto, are incorporated herein by reference in its entirety.

TECHNICAL FIELD

The present invention relates to a drilling speed increasing device driven by a downhole motor for generating shock vibration, which is used for increasing drilling speed in petroleum drilling engineering.

BACKGROUND OF THE PRESENT INVENTION

In the drilling process, a rock breaking mode is an important factor that affects drilling speed. Downhole obstruction or sticking of a drilling tool seriously affect the drilling process. With the continuous deepening of exploration and development and the increase of horizontal wells and complex wells with large displacement, how to reduce friction resistance, reduce conventional drilling accidents of sticking of the drilling tool, increase dynamic drilling pressure and improve the efficiency of conventional drilling become difficult problems to be urgently solved in the drilling process.

At present, in petroleum drilling, the drilling pressure required by the drill bit is provided by the weight of a drill collar on the upper part of the drill bit. The traditional rigid pressurization modes have many unavoidable disadvantages, such as uneven drilling, bending of jumping drills, false drilling pressure and the like. These disadvantages severely affect the mechanical drilling speed and the life of the drill bit and the drilling tool, and especially make it difficult to transmit the drilling pressure in drilling the horizontal wells, thereby resulting in low rock breaking efficiency of the drill bit and affecting the drilling speed.

SUMMARY OF THE PRESENT INVENTION

Based on the above technical problems, the present invention provides a drilling speed increasing device driven by a downhole motor for generating shock vibration.

The present invention adopts the following technical solution:

A drilling speed increasing device driven by a downhole motor for generating shock vibration includes a main shaft, a torque transmission sleeve, a drill bit sub, an upper housing, a middle housing and a lower housing, wherein an upper end of the main shaft is fixedly connected with a rotor of a motor; a lower end of the main shaft is in transmission connection with an upper end of the drill bit sub through the torque transmission sleeve; a lower end of the drill bit sub is connected with a drill bit; an upper end of the upper housing is fixedly connected with a stator of the motor; the upper housing is fixedly connected with the middle housing and the lower housing; an energy conversion mechanism capable of converting axial rotational energy of the motor into the axial vibration shock energy is arranged between the drill bit sub and the lower housing; the energy conversion mechanism comprises a shock seat, a spring and a vibration starter; the vibration starter is arranged at the bottom of the shock seat; a spring space is formed between the shock seat and the lower housing; the spring is installed in the spring space; the vibration starter comprises an upper vibration starter and a lower vibration starter; the upper vibration starter is fixedly connected with the shock seat; the lower vibration starter is fixedly connected with the drill bit sub; matched curved tracks are arranged on the upper vibration starter and the lower vibration starter; rolling steel balls are placed in the curved tracks; when the lower vibration starter rotates with the main shaft, the upper vibration starter generates periodic displacement change in an axial direction, so as to drive the spring to generate periodic compression and release, so that the drill bit generates periodic axial vibration;

the drill bit sub is provided with a lower TC bearing outer ring; the top end of the lower TC bearing outer ring is provided with a lower locking nut; a lower TC bearing outer ring positioning sheath is arranged at the bottom end of the lower TC bearing outer ring; the lower housing is provided with a lower TC bearing inner ring; the lower TC bearing outer ring is in close contact with the lower TC bearing inner ring; the main shaft is provided with an upper TC bearing outer ring; the top end of the upper TC bearing outer ring is provided with an upper locking nut; a thrust bearing group is arranged at the bottom end of the upper TC bearing outer ring; the upper housing is provided with an upper TC bearing inner ring; and the upper TC bearing outer ring is in close contact with the upper TC bearing inner ring;

a first bulge is arranged on the top end of the upper vibration starter; a first groove matched and connected with the first bulge is arranged on the bottom end of the shock seat; a second bulge is arranged on the bottom end of the lower vibration starter; and a second groove matched and connected with the second bulge is arranged on the top end of the lower locking nut;

a shim for adjusting a pre-tightening force of the spring is arranged at the bottom of the spring space.

The present invention has the following beneficial technical effects:

Through the reasonable design of the energy conversion mechanism and the like, the present invention can convert part of the rotational energy of the main shaft into drilling pressure to generate periodic mild axial vibration shock, thereby increasing the drilling pressure in the drilling process and significantly reducing the loss of the drilling pressure in the drilling process, so as to increase the drilling speed, prolong the service life of a drilling tool, reduce stick-slip and sticking of the drilling tool in the drilling process and increase the depth that can be achieved by drilling horizontal wells, multilateral wells and coiled tubing/through-tubing.

BRIEF DESCRIPTION OF THE DRAWINGS

The present invention is further described below with reference to the drawings and in combination with specific embodiments.

Figure 1:
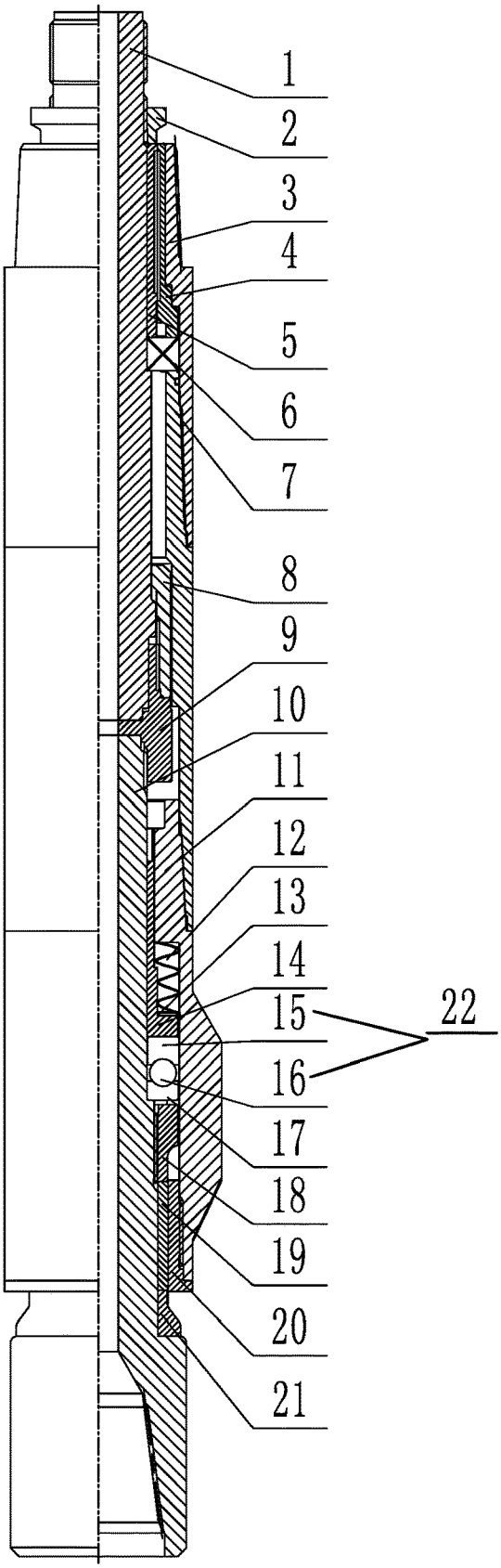
FIG. 1 shows a structural schematic diagram of the present invention.

In the drawings: 1—main shaft; 2—upper locking nut; 3—upper housing; 4—upper TC bearing inner ring; 5—upper TC bearing outer ring; 6—thrust bearing group; 7—middle housing; 8-shoulder sheath; 9-torque transmission sleeve; 10-drill bit sub; 11-lower housing; 12-spring; 13-shim; 14-shock seat; 15-upper vibration starter; 16-rolling steel ball; 17-lower vibration starter; 18-lower locking nut; 19-lower TC bearing outer ring; 20-lower TC bearing inner ring; 21-lower TC bearing outer ring positioning sheath; and 22-vibration starter.

DETAILED DESCRIPTION OF THE PRESENT INVENTION

The present invention uses the axial rotational energy of a drilling motor to generate high-frequency and low-amplitude axial vibration shock, and changes the method of applying drilling pressure by means of the weight of a lower drill collar in conventional drilling or other work. The device uses the rotational energy of a screw motor (a turbo motor also applies) as the power to drive the lower vibration starter to rotate. Since the upper vibration starter is matched with the lower housing, can only move back and forth in the axial direction and cannot rotate with the lower vibration starter, the upper vibration starter and the lower vibration starter generate relative rotation. The vibration starting steel balls have the function of reducing friction in the interior. During the axial reciprocating motion of the upper vibration starter, the spring matched with the upper vibration starter is periodically compressed to generate spring energy. The spring energy reacts on the lower vibration starter, and the main shaft and the drill bit sub which are connected with the drill bit, so as to periodically provide the drilling pressure for the drill bit. Periodic motion of the upper vibration starter and the spring produces periodic axial vibration on the tool. The present invention can increase the drilling pressure in the work process, reduce stick-slip and sticking of the drilling tool in the drilling process, increase mechanical drilling speed, prolong the service life of the drill bit, and further increase the depth that can be achieved by drilling horizontal wells, multilateral wells and coiled tubing/through-tubing.

The present invention is described below in detail with reference to the drawings and in combination with specific embodiments.

With reference to the drawings, a drilling speed increasing device driven by a downhole motor for generating shock vibration includes a main shaft 1, a torque transmission sleeve 9, a drill bit sub 10, an upper housing 3, a middle housing 7 and a lower housing 11. An upper end of the main shaft 1 is fixedly connected with a rotor of a motor; a lower end of the main shaft 1 is in transmission connection with an upper end of the drill bit sub 10 through the torque transmission sleeve 9; and a lower end of the drill bit sub 10 is connected with a drill bit. An upper end of the upper housing 3 is fixedly connected with a stator of the motor; the bottom of the upper housing 3 is connected with the top of the middle housing 7; and the bottom of the middle housing 7 is connected with the top of the lower housing 11. An energy conversion mechanism capable of converting axial rotational energy of the motor into the axial vibration shock energy is arranged between the drill bit sub 10 and the lower housing 11; the energy conversion mechanism includes a shock seat 14, a spring 12 and a vibration starter 22; and the vibration starter 22 is arranged at the bottom of the shock seat 14. A spring space is formed between the shock seat 14 and the lower housing 11; and the spring 12 is installed in the spring space. The vibration starter 22 includes an upper vibration starter 15 and a lower vibration starter 17; the upper vibration starter 15 is fixedly connected with the shock seat 14; the lower vibration starter 17 is fixedly connected with the drill bit sub 10; matched curved tracks are arranged on the upper vibration starter 15 and the lower vibration starter 17; and rolling steel balls 16 are placed in the curved tracks. When the lower vibration starter 17 rotates with the main shaft 1, the upper vibration starter 15 generates periodic displacement change in an axial direction, so as to drive the spring 12 to generate periodic compression and release, so that the drill bit generates periodic axial vibration.

The drilling speed increasing device of the present invention mainly uses the rotational energy of the rotor of the drilling motor as the power to convert part of the rotational energy into the drilling pressure to generate periodic mild axial vibration shock. The rotor is connected with the main shaft to drive the lower vibration starter to rotate. After the lower vibration starter generates motion relative to the upper vibration starter and the housings, a spring force is generated and acts on the lower vibration starter to generate the periodic axial vibration shock. The periodic axial vibration shock is transmitted to the drill bit through the drill bit sub to form drilling pressure that has continuous period change.

As further design for the present invention, the drill bit sub 10 is provided with a lower TC bearing outer ring 19; the top end of the lower TC bearing outer ring 19 is provided with a lower locking nut 18; a lower TC bearing outer ring positioning sheath 21 is arranged at the bottom end of the lower TC bearing outer ring; the lower housing 11 is provided with a lower TC bearing inner ring 20; and the lower TC bearing outer ring 19 is in close contact with the lower TC bearing inner ring 20. The lower locking nut 18 is fixedly connected to the drill bit sub by means of a thread. The lower TC bearing outer ring 19 is fastened by means of the lower locking nut 18. The lower TC bearing inner ring 20 is in threaded connection with the lower housing. Through the close contact of the lower TC bearing inner ring 20 and the lower TC bearing outer ring 19, the drill bit sub can be prevented from falling into the bottom of the well after the tool fails. The main shaft 1 is provided with an upper TC bearing outer ring 5; the top end of the upper TC bearing outer ring 5 is provided with an upper locking nut 2; a thrust bearing group 6 is arranged at the bottom end of the upper TC bearing outer ring 5; the upper housing 3 is provided with an upper TC bearing inner ring 4; and the upper TC bearing outer ring 5 is in close contact with the upper TC bearing inner ring 4. The upper locking nut 2 is fixedly connected to the main shaft 1 by means of the thread, and the upper TC bearing outer ring 5 is fixed by means of the upper locking nut 2. The upper locking nut 2 not only can fasten the upper TC bearing outer ring 5, but also can prevent the tool from falling in the well after an accident occurs. The upper TC bearing inner ring 4 and the upper housing 3 are connected by the threads.

Further, a first bulge is arranged on the top end of the upper vibration starter 15; and a first groove matched and connected with the first bulge is arranged on the bottom end of the shock seat 14. A second bulge is arranged on the bottom end of the lower vibration starter 17; and a second groove matched and connected with the second bulge is arranged on the top end of the lower locking nut 18.

More further, a shim 13 for adjusting a pre-tightening force of the spring is arranged at the bottom of the spring space. The adjustment of the pre-tightening force of the spring is changed by means of the shim 13 for adjusting the pre-tightening force. The magnitude of the vibration force depends on the magnitude of the pre-tightening force of the spring. Therefore, the vibration force can be adjusted by adjusting the pre-tightening force of the spring. Meanwhile, the magnitude of the periodic axial shock force also depends on the arrangement mode of the spring in the spring space.

Figure 3:
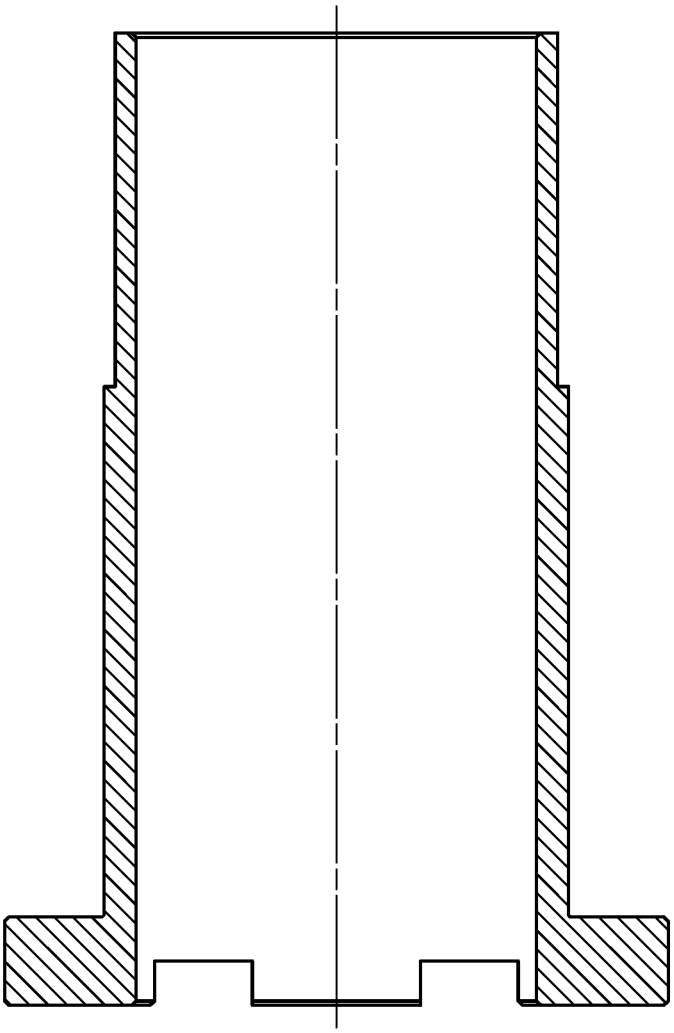
FIG. 3 shows a structural schematic diagram of an upper vibration starter in the present invention.
Figure 4:
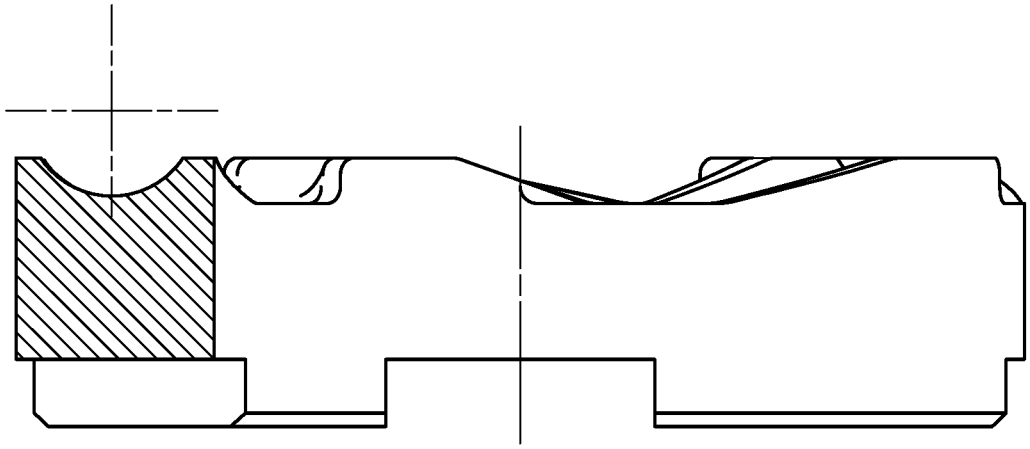
FIG. 4 shows a structural schematic diagram of a lower vibration starter in the present invention.
Figure 5:
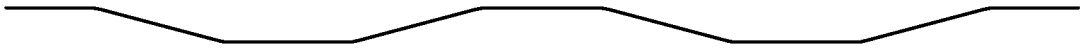
FIG. 5 shows a sectional view of a curved track arranged on a lower vibration starter, and mainly shows peaks and troughs of the curved track.

In the above drilling speed increasing device, the vibration amplitude depends on the distance between a peak and a trough of the regular curved track on the upper vibration starter 15 and the lower vibration starter 17. In specific design, the bottom surface of the upper vibration starter 15 can also be arranged as a flat track, and the top surface of the lower vibration starter 17 can be arranged as a matched regular curved track, as shown in FIG. 3 to FIG. 5. When a vibration starting mechanism works normally, the upper vibration starter 15 and the lower vibration starter 17 generate periodic displacement change, so that the tool generates periodic axial vibration.

Figure 2:
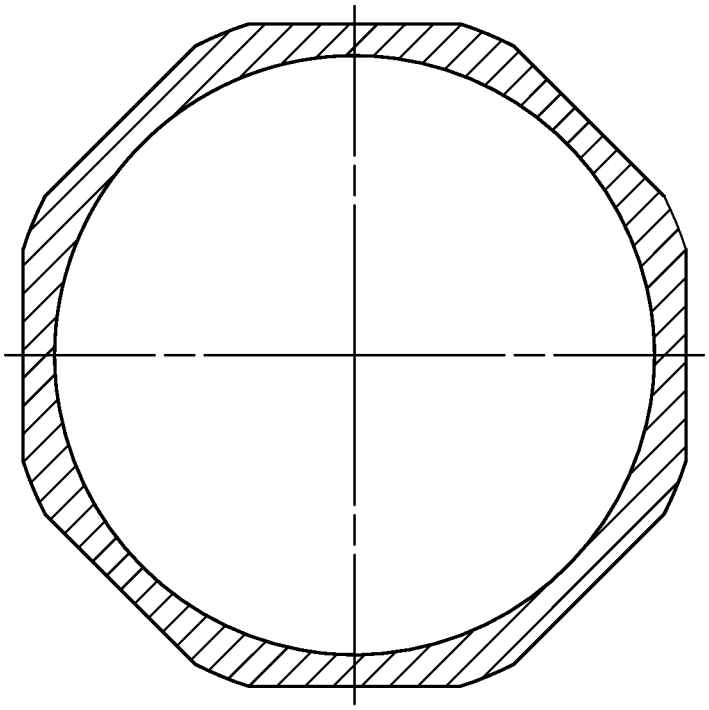
FIG. 2 shows a regular polyhedron structure of a shock seat in the present invention.

In the above drilling speed increasing device, the shock seat 14 may adopt such a manner that an outer cylindrical surface of a regular polyhedron is matched with an inner cavity of the regular polyhedron of the lower housing 11, as shown in FIG. 2, so that the shock seat 14 cannot axially rotate, and can only axially vibrate. Similarly, the main shaft 1 can also adopt such a manner that a shoulder of the regular polyhedron is matched with the inner cavity of the regular polyhedron of the shoulder sheath 8 to transmit the torque. The shoulder sheath 8 is matched with the shoulder of the main shaft 1 to prevent the drill bit sub 10 from separating the main shaft 1 after the lower TC bearing and the lower housing 11 fall and to prevent the tool falling in the well.

In the above drilling speed increasing device, the shock seat 14 and the upper vibration starter 15 can move along the axial direction of the main shaft 1, but cannot rotate with the main shaft 1.

In the process of lowering the tool, the shoulder sheath 8 can move downwards by means of the weight of the drill bit sub 10 and the components installed on the drill bit sub. The pre-tightening force of the spring 12 in the process of lowering the tool is reduced. When the drill bit touches the wall of the well, the spring 12 has the function of buffering and prevents the tool from being misoperated, so as to protect the drilling speed increasing device driven by the downhole motor for generating shock vibration.

In the above drilling speed increasing device, the type of threaded connection between the torque transmission sleeve 9 and the drill bit sub 10 is left-hand thread connection.

In the above drilling speed increasing device, the arrangement of a thrust ball bearing group can reduce the wear during relative rotation between the housing mechanism (including the upper housing 3, the middle housing 7 and the lower housing 11) and a main shaft mechanism. Of course, in order to further reduce the wear, a TC bearing mechanism can also be arranged in the main position of the drilling speed increasing device.

In the above drilling speed increasing device, mud is used to cool the tool in the operation process of the tool.

The installation sequence and the construction use method of the drilling speed increasing device of the present invention are described below.

The installation sequence of the drilling speed increasing device of the present invention is as follows:

Firstly, the lower TC bearing outer ring positioning sheath 21, the lower TC bearing outer ring 19, the lower TC bearing inner ring 20 and the lower locking nut 18 are successively arranged on the drill bit sub 10, and the thread position on the lower locking nut 18 is matched with the thread position on the drill bit sub, so as to fix the lower TC bearing outer ring positioning sheath 21 and the lower TC bearing outer ring 19 to the drill bit sub 10. The lower bulge of the lower vibration starter 17 is matched with the groove on the top end of the lower locking nut 18. The vibration starter steel balls 16 are arranged into the curved groove of the lower vibration starter 17. Subsequently, the upper vibration starter 15 is assembled to the drill bit sub, and the bottom groove of the upper vibration starter 15 is matched with the vibration starter steel balls 16. The position of the groove of the shock seat 14 is matched with a raised key of the upper vibration starter 15. The shim 13 for the pre-tightening force and the spring 12 are installed into the cylindrical surface of the shock seat 14 at a time. The lower housing 11 is matched with the drill bit sub as shown in the figure, and the lower TC bearing outer ring 19 is in thread fit with the lower housing 11. The shoulder sheath 8 is installed on the main shaft 1 so that the thread position of the shoulder sheath 8 is close to the lower end of the main shaft 1 and the inner cavity of the regular polyhedron of the shoulder sheath 8 is matched with the shoulder of the regular polyhedron of the main shaft. The shoulder sheath 8 is in thread fit with the torque transmission sleeve 9, and the other end of the torque transmission sleeve 9 is in threaded connection with the drill bit sub. Then, the middle housing 7, the thrust ball bearing group 6, the upper TC bearing outer ring 5 and the upper TC bearing inner ring 4 are installed into the main shaft 1 at a time, and the middle housing 7 and the lower housing 11 are tightly matched. The upper housing 3 is matched with the upper TC bearing inner ring 4 and is fastened through thread with the upper end of the middle housing 7. Finally, the upper locking nut 2 is matched with the thread position of the main shaft 1, and the upper TC bearing outer ring 5 is fixed.

The construction use method of the drilling speed increasing device of the present invention (taking a screw drilling tool as an example) is as follows:

The upper thread position of the upper housing 3 of the present invention is in thread fastening with the stator of a screw motor. The upper thread position of the main shaft 1 of the present invention is matched and fastened with the rotor of the screw motor. When the shoulder sheath 8 is matched with the end surface of the shoulder of the main shaft 1 by means of the end surface of the shoulder in the process of lowering the tool, the drill bit sub and the components installed on the drill bit sub are separated from the working positions and move downwards, so that the spring space is increased and the spring is in a small amount of compressed state or natural state. Even if the drill bit touches the wall of the well in the lowering process, the spring will have a certain buffering effect on the drill bit, thereby avoiding damaging the drill bit caused by touching the wall of the well. After entering the well, when the screw motor starts to work, the lower end surface of the main shaft 1 is matched with the end surface of the inner cavity of the torque transmission sleeve 9 to transmit the drilling pressure to the drill bit sub. The main shaft 1 and the drill bit sub have the same rotational speed as the screw motor, and transmit the torque to the torque transmission sleeve 9 by means of the shoulder of the regular polyhedron. The torque transmission sleeve 9 transmits the torque to the drill bit sub 10. The drill bit sub will drive the lower locking nut 18 and the lower vibration starter 17 to rotate together. Since the curved surfaces of the upper vibration starter 15 and the lower vibration starter 17 matched with the rolling steel balls 16 are uneven regular curves, the convex surfaces are matched with each other or the convex surfaces and concave surfaces are matched when the lower vibration starter 17 rotates. Thus, the relative positions of the upper vibration starter 15 and the lower vibration starter 17 are changed, thereby driving the spring 12 to generate periodic compression and release and making the drilling speed increasing device generate periodic vibration. The periodically generated spring force is transmitted to the drill bit, so that the drill bit not only bears the fixed drilling pressure in the drilling process, but also has the effect of periodic shock drilling, thereby increasing the drilling speed and protecting the drill bit. The periodic axial vibration generated by the tool is not only beneficial for increasing the drilling speed of the drill bit and protecting the drill bit, but also can avoid friction between a drill rod and the wall of the well to reduce friction resistance, thereby improving the quality of the wall of the well.

Relevant technical content not mentioned in the above embodiments can be achieved by taking or learning from the prior art.

It should be noted that, under the instruction of this description, any equivalent substitution mode or apparent variation mode made by those skilled in the art shall belong to the protection scope of the present invention.

We claim:

1. A drilling speed increasing device driven by a downhole motor for generating shock vibration, comprising a main shaft, a torque transmission sleeve, a drill bit sub, an upper housing, a middle housing and a lower housing, wherein an upper end of the main shaft is fixedly connected with a rotor of a motor; a lower end of the main shaft is in transmission connection with an upper end of the drill bit sub through the torque transmission sleeve; a lower end of the drill bit sub is connected with a drill bit; an upper end of the upper housing is fixedly connected with a stator of the motor; the upper housing is fixedly connected with the middle housing and the lower housing; an energy conversion mechanism capable of converting axial rotational energy of the motor into the axial vibration shock energy is arranged between the drill bit sub and the lower housing; the energy conversion mechanism comprises a shock seat, a spring and a vibration starter; the vibration starter is arranged at the bottom of the shock seat; a spring space is formed between the shock seat and the lower housing; the spring is installed in the spring space; the vibration starter comprises an upper vibration starter and a lower vibration starter; the upper vibration starter is fixedly connected with the shock seat; the lower vibration starter is fixedly connected with the drill bit sub; matched curved tracks are arranged on the upper vibration starter and the lower vibration starter; rolling steel balls are placed in the curved tracks; when the lower vibration starter rotates with the main shaft, the upper vibration starter generates periodic displacement change in an axial direction, so as to drive the spring to generate periodic compression and release, so that the drill bit generates periodic axial vibration;

the drill bit sub is provided with a lower tungsten carbide (TC) bearing outer ring; the top end of the lower TC bearing outer ring is provided with a lower locking nut; a lower TC bearing outer ring positioning sheath is arranged at the bottom end of the lower TC bearing outer ring;

the lower housing is provided with a lower TC bearing inner ring; the lower TC bearing outer ring is in close contact with the lower TC bearing inner ring; the main shaft is provided with an upper TC bearing outer ring; the top end of the upper TC bearing outer ring is provided with an upper locking nut; a thrust bearing group is arranged at the bottom end of the upper TC bearing outer ring; the upper housing is provided with an upper TC bearing inner ring; and the upper TC bearing outer ring is in close contact with the upper TC bearing inner ring;

a first bulge is arranged on the top end of the upper vibration starter; a first groove matched and connected with the first bulge is arranged on the bottom end of the shock seat; a second bulge is arranged on the bottom end of the lower vibration starter; and a second groove matched and connected with the second bulge is arranged on the top end of the lower locking nut;

a shim for adjusting a pre-tightening force of the spring is arranged at the bottom of the spring space.

* * * * *